US010731943B2

(12) United States Patent
Horn et al.

(10) Patent No.: US 10,731,943 B2
(45) Date of Patent: Aug. 4, 2020

(54) DRAW CORD ENGAGEMENT SYSTEM AND METHOD FOR ARCHERY RELEASE DEVICES

(71) Applicant: TOG-IP LLC, West Henrietta, NY (US)

(72) Inventors: Charles E. Horn, Cedar Rapids, IA (US); Derek A. Woods, Avon, NY (US)

(73) Assignee: TOG-IP LLC, West Henrietta, NY (US)

( * ) Notice: Subject to any disclaimer, the term of this patent is extended or adjusted under 35 U.S.C. 154(b) by 0 days.

(21) Appl. No.: 16/223,442

(22) Filed: Dec. 18, 2018

(65) Prior Publication Data

US 2019/0186864 A1 Jun. 20, 2019

Related U.S. Application Data

(60) Provisional application No. 62/599,839, filed on Dec. 18, 2017.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469; F41B 5/1473
See application file for complete search history.

(56) References Cited

U.S. PATENT DOCUMENTS

| | | | | |
|---|---|---|---|---|
| 5,653,214 | A | 8/1997 | Lynn | |
| 5,666,936 | A | 9/1997 | Estrada | |
| 6,571,786 | B2 | 6/2003 | Summers et al. | |
| 6,945,241 | B2 | 9/2005 | Pellerite | |
| 8,402,957 | B1 | 3/2013 | Clark | |
| 8,746,223 | B2 | 6/2014 | Jones | |
| 8,997,729 | B1 | 4/2015 | Gillig | |
| 9,982,961 | B1 * | 5/2018 | Rentz | F41B 5/1469 |
| 2002/0162546 | A1 * | 11/2002 | Mugg | F41B 5/1469 124/35.2 |
| 2003/0154969 | A1 * | 8/2003 | Carter | F41B 5/1469 124/78 |

(Continued)

OTHER PUBLICATIONS

"TruBall Releases," T.R.U. Ball Archery, Sep. 10, 2015; retrieved from the Internet: <web.archive.org/web/20150906083915/http://www.truball.com>, 3 pages.

(Continued)

*Primary Examiner* — John E Simms, Jr.
(74) *Attorney, Agent, or Firm* — Barclay Damon LLP

(57) ABSTRACT

A draw cord engagement system and method are disclosed herein. The draw cord engagement system, in an embodiment, includes a support, a cord holder moveably coupled to the support, a first engager moveably coupled to the support, and a second engager moveably coupled to the support. The draw cord engagement system is configured to enable a first repositioning of the first engager relative to the second engager, resulting in a first setting. The draw cord engagement system is also configured to enable a second repositioning of at least the second engager relative to the support while the first setting remains unchanged.

23 Claims, 14 Drawing Sheets

(56) References Cited

U.S. PATENT DOCUMENTS

| | | | | |
|---|---|---|---|---|
| 2011/0168146 | A1* | 7/2011 | Deceuster | F41B 5/1469 124/35.2 |
| 2016/0138887 | A1* | 5/2016 | Kelly | F41B 5/1469 124/35.2 |
| 2016/0195359 | A1 | 7/2016 | Trpkovski | |
| 2017/0089662 | A1 | 3/2017 | Horn | |
| 2017/0089663 | A1 | 3/2017 | Horn | |
| 2017/0261284 | A1 | 9/2017 | Horn | |

OTHER PUBLICATIONS

Carter Enterprises; 2 Moons web page; Aug. 22, 2015; 1 page.
Carter Entrprises; 2 Moons Instructions; Aug. 22, 2015, 1 page.
Carter Enterprises; Carter 2 Moon Video; Feb. 26, 2017; <https://www.youtube.com/watch?v=JMiU9NMP_0U>; 5 pages.

* cited by examiner

DRAW CORD ENGAGEMENT SYSTEM AND METHOD FOR ARCHERY RELEASE DEVICES

CROSS-REFERENCE TO RELATED APPLICATION

This application is a non-provisional of, and claims the benefit and priority of, U.S. Provisional Patent Application No. 62/599,839 filed on Dec. 18, 2017. The entire contents of such application are hereby incorporated herein by reference.

BACKGROUND

Handheld release aids are commonly used to assist archers in grasping, drawing, and releasing bowstrings. Such aids not only protect an archer's hand and fingers but also serve to improve shooting accuracy. Some known release aids have a mechanical trigger that is operable to release the bowstring. Other known release aids are triggerless. Triggerless releases include a pivotal part (e.g., a sear) that contacts a bowstring hook. When the user pulls the bowstring quickly, the hook becomes freed from the pivotal part, resulting in a release of the bowstring.

Some triggerless release aids generate a click sound just before the release occurs. Other triggerless release devices enable the archer to adjust the position in which the hook is freed. The timing of the click sound and the setting of the release position can be important factors in shooting performance. Through experience, archers determine the factors that are best suited for their particular physiology, shooting psychology and shooting style. The known release aids (trigger-based and triggerless) do not enable the archer to independently adjust these factors.

Consequently, archers must undergo substantial labor, time and effort to repeat lost settings for both factors when adjusting just one factor. As a result, many archers shoot without taking the time to make the adjustments. This hinders shooting performance, consistency and accuracy. Other archers purchase and carry multiple types of release aids to address the problems described above. This adds to the cost and complexity of archery shooting.

The foregoing background describes some, but not necessarily all, of the problems, disadvantages and shortcomings related to releasing bowstrings and draw cords.

SUMMARY

The present disclosure describes a draw cord engagement system and method. In an embodiment, the draw cord engagement system includes a support and a cord holder moveably coupled to the support. The cord holder is configured to hold a draw cord. The system also includes: (a) a first engager moveably coupled to the support, wherein the first engager is configured to engage the cord holder; and (b) a second engager moveably coupled to the support, wherein: (i) the second engager is configured to engage the cord holder; and (ii) the second engager is configured to be repositioned relative to the first engager. Also, the system includes a coupler configured to couple the first engager to the second engager. The cord holder, the first engager, the second engager and the coupler are configured to cooperate with each other to enable: (a) a first repositioning of the first engager relative to the second engager, wherein the first repositioning results in a first setting associated with a notice period; and (b) a second repositioning of at least the second engager relative to the support without causing a change in the first setting, wherein the second repositioning results in a second setting associated with a release event. In response to a force applied to the cord holder, the cord holder is configured to: (a) disengage the first engager; (b) then engage with the second engager; and (c) then disengage the second engager to enable the cord holder to release the draw cord, resulting in the release event.

In another embodiment, the draw cord engagement system includes: (a) a support; (b) a cord holder moveably coupled to the support; (c) a first engager moveably coupled to the support; and (d) a second engager moveably coupled to the support, wherein the second engager is configured to be repositioned relative to the first engager. The cord holder, the first engager and the second engager are configured to cooperate with each other to enable: (a) a first repositioning of the first engager relative to the second engager resulting in a first setting; and (b) a second repositioning of at least the second engager relative to the support while the first setting remains unchanged.

In an embodiment, the method for manufacturing a draw cord engagement system includes: (a) providing a support; (b) moveably coupling a cord holder to the support; (c) moveably coupling a first engager to the support; and (d) moveably coupling a second engager to the support so that the second engager is repositionable relative to the first engager. The cord holder, the first engager and the second engager are operable to cooperate with each other to enable: (a) a first repositioning of the first engager relative to the second engager resulting in a first setting; and (b) a second repositioning of at least the second engager relative to the support while the first setting remains unchanged.

Additional features and advantages of the present disclosure are described in, and will be apparent from, the following Brief Description of the Drawings and Detailed Description.

DETAILED DESCRIPTION

Figure 1:
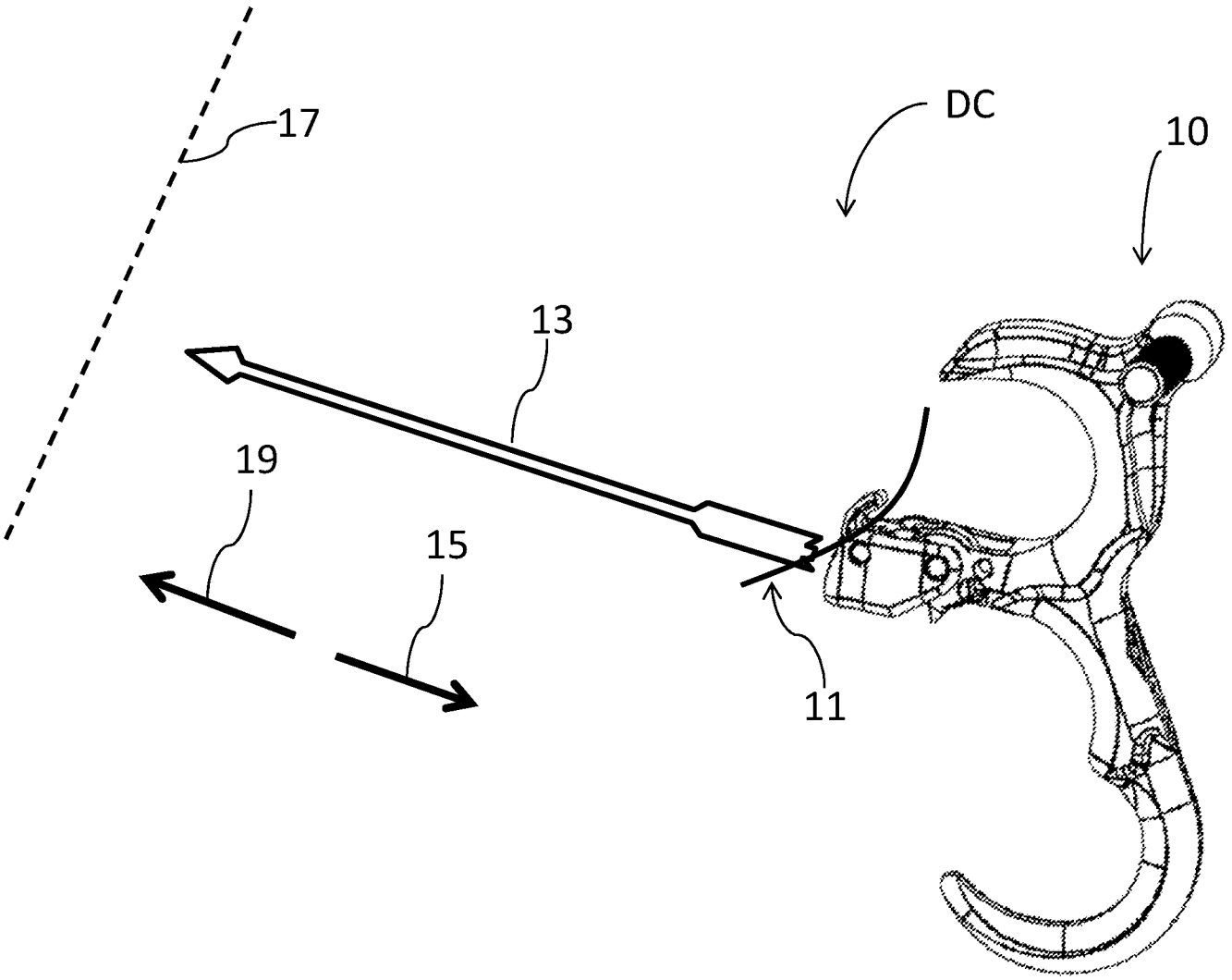
FIG. 1 is a side view of an embodiment of an archery release device.

FIG. 1 illustrates an example of the archery release device 10 in a draw position or draw condition DC. The archery release device 10 is configured to be removably coupled to a bowstring or draw cord 11 of an archery bow (not shown), such as an archery compound bow, archery recurve bow or another type of projectile launcher that involves the retraction of a string or cord 11 that, upon release, applies a launching force to a projectile 13. Depending upon the embodiment, the archery release device 10 can be a triggerless release, such as a back tension release, or the archery release device 10 can be a trigger-based released. In the embodiment shown, the archery release device 10 is triggerless in that the archery release device 10 disengages the draw cord 11 in response to the archer's pulling or jerking on the archery release device 10. The spike in force resulting from the jerking or quick pull can be caused by tensing or flexing of the archer's back, arm or hand muscles.

In an embodiment not shown, the archery release device 10 of the present disclosure is a trigger-based release device having a moveable trigger. When the archer activates the trigger, the trigger-based release device disengages the draw cord 11. Although the embodiments illustrated in this disclosure show a triggerless release device 10, it should be appreciated that in other embodiments, the archery release device 10, or its components, can have a trigger-based configuration that incorporates a trigger and a triggering mechanism having one or more linkages, sears and springs.

As further shown in FIG. 1, the user may couple the archery release device 10 to the draw cord 11, typically after or while coupling the arrow or projectile 13 to the draw cord 11. In operation, the user draws the archery release device 10 in a rearward direction 15 away from a target 17, thereby putting tension on the draw cord 11. The user generates a release force based on a spike in the user's pulling force, caused, for example, by a quick tensing or flexing of the user's back muscles, causing the archery release device 10 to release the draw cord 11. The released draw cord 11 then propels the projectile 13 in a forward direction 19 away from the user and toward the target 17.

Figure 2:
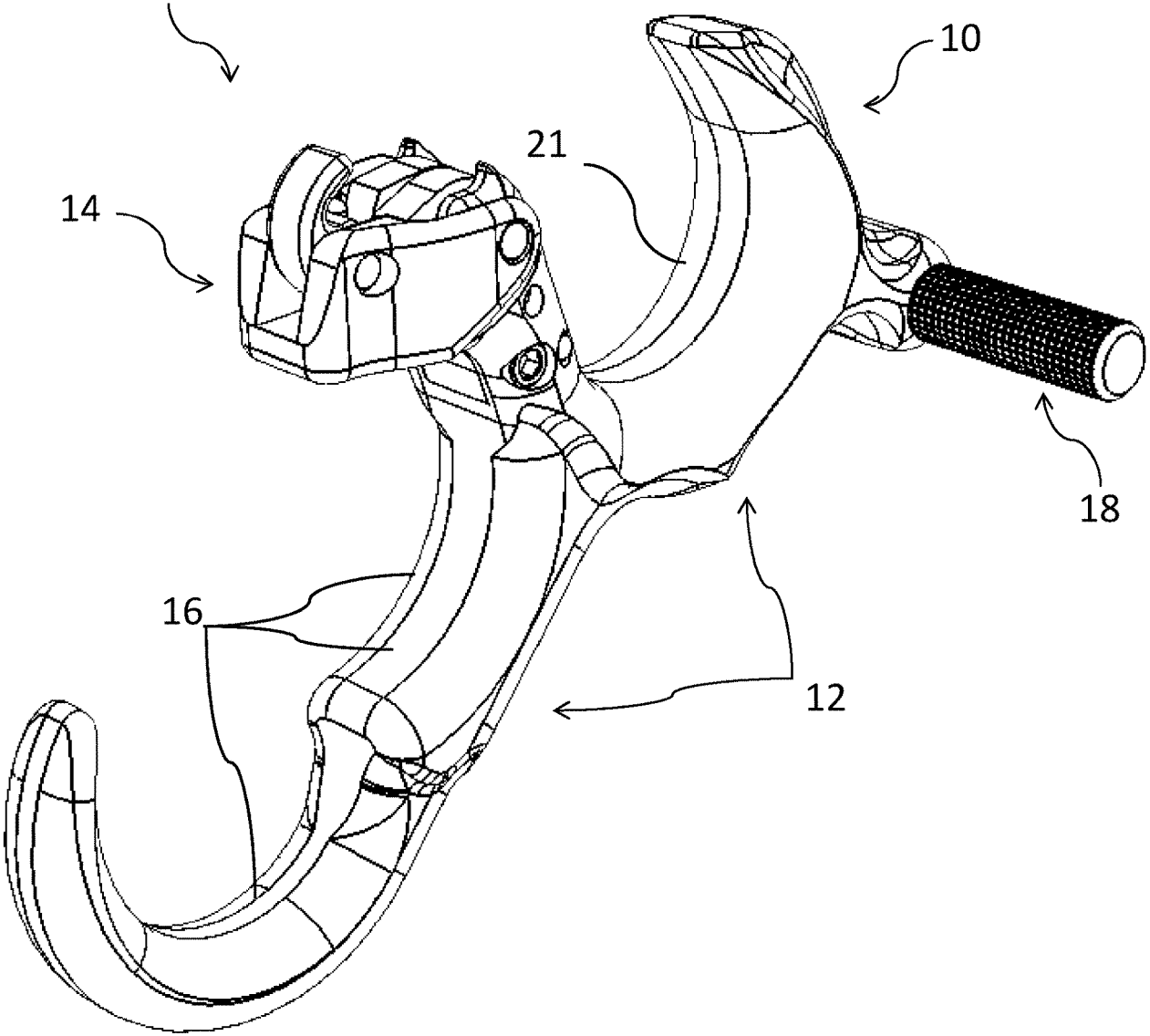
FIG. 2 is an isometric view of the archery release device of FIG. 1.

In an embodiment illustrated in FIG. 2, the archery release device 10 includes a housing or body 12, a draw cord engagement system 14 and a thumb rest 18 configured to support a thumb of the user. The body 12 includes or defines a lower handgrip 16 and an upper handgrip 21. The lower handgrip 16 includes a wave shape that defines valley-shaped middle finger and ring finger interfaces for ergonomic engagement with the middle and ring fingers of the user. The upper handgrip 21 defines an arc-shaped index finger interface for ergonomic engagement with the user's index finger. In an embodiment not shown, the body 12 has grooves or notches to enable or facilitate ergonomic engagement with the archer's fingers. The thumb rest 18 is coupled to the body 12 in a position spaced apart from the upper handgrip 21. The user may grasp the body 12 by wrapping the user's index, middle and ring fingers around the body 12 while resting the user's thumb on the thumb rest 18.

Figure 3:
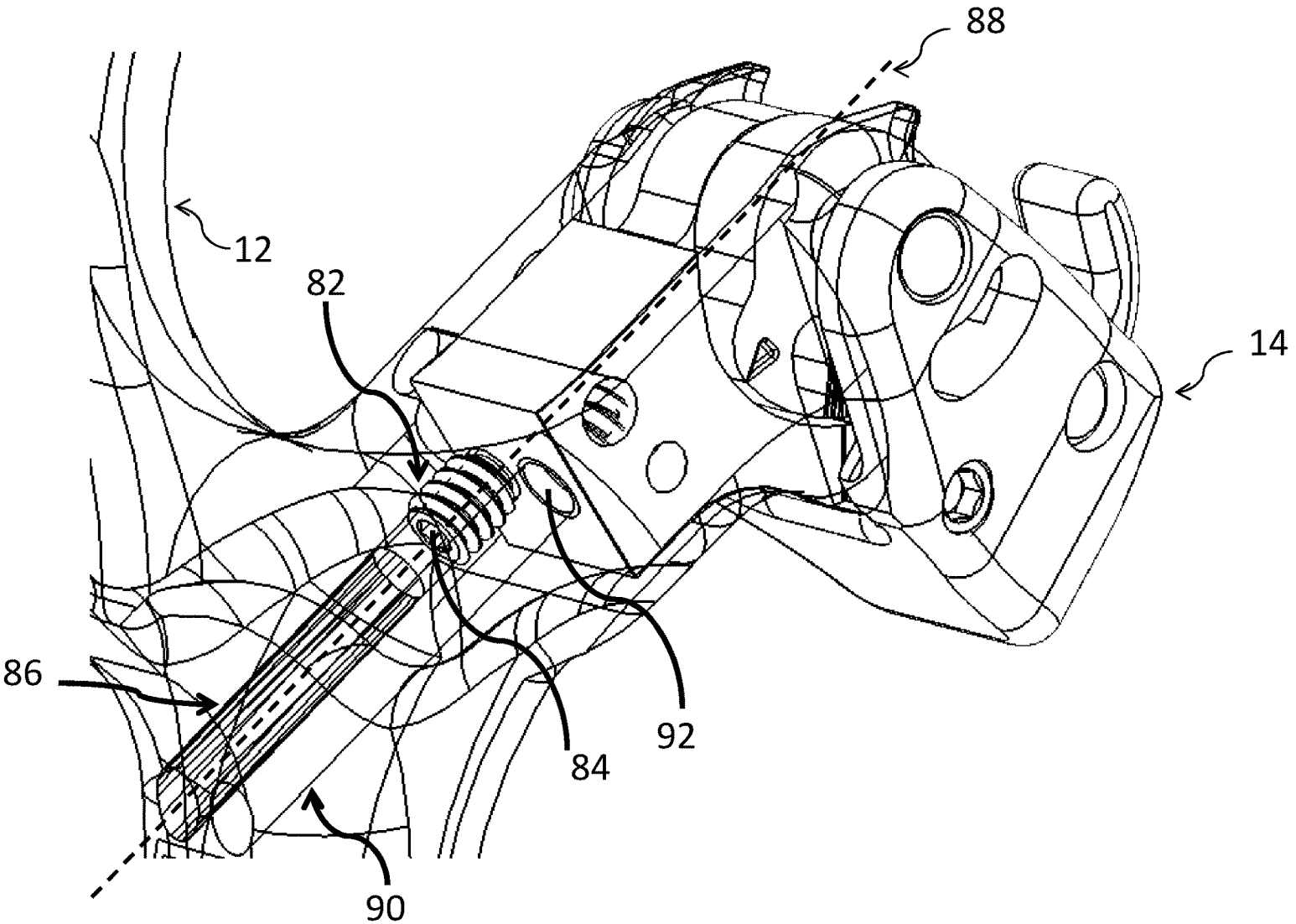
FIG. 3 is an enlarged, fragmentary, isometric view of the archery release device of FIG. 1, illustrating internal elements.

In the embodiment illustrated in FIG. 3, the archery release device 10 is adjustable to change the draw length. Draw length depends on the user's unique arm span and body size. Changing the position of the draw cord engagement system 14 along axis 88 enables the user to adjust the draw length. In an embodiment, the archery release device 10 includes a draw length adjuster 82. The draw length adjuster 82 connects the draw cord engagement system 14 to the body 12, and the draw length adjuster 82 has a helical surface defined by winding grooves or a plurality of threads. The draw length adjuster 82 may define a tool receiver 84 configured to receive an end of a wrench or tool. The draw length adjuster 82 is disposed in the passageway or bore 86 of the body 12. The bore 86 enables a wrench or tool to access the tool receiver 84 of the draw length adjuster 82. Rotation of the draw length adjuster 82 causes the draw cord engagement system 14 to move forward or rearward along the axis 88.

Figure 4A:
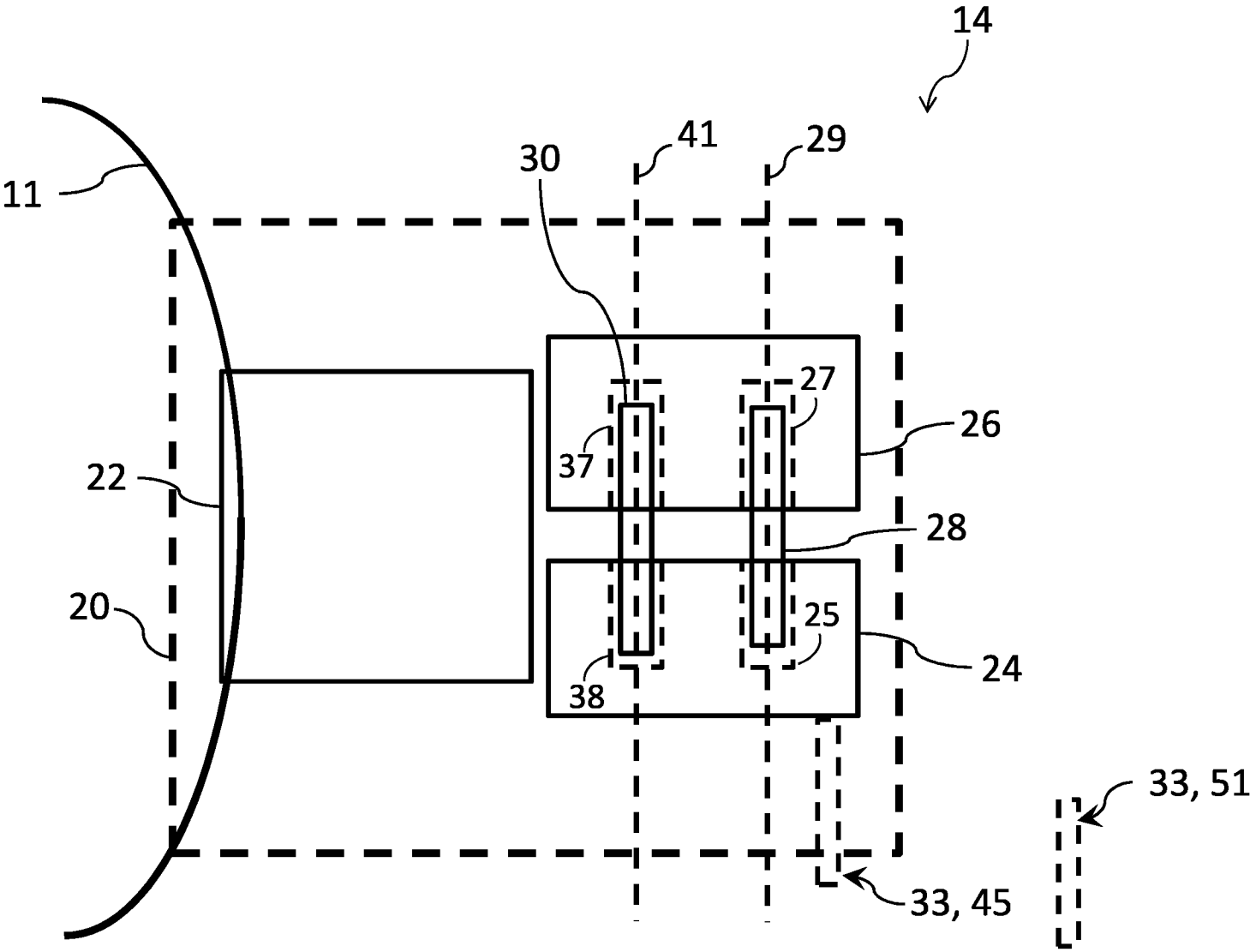
FIG. 4A is a schematic diagram illustrating an embodiment of a draw cord engagement system.

Referring to FIG. 4A, the draw cord engagement system 14 is configured to be releasably coupled to the draw cord 11, as described above. In an embodiment, the draw cord engagement system 14 includes: (a) a carriage, base or support 20; (b) a cord holder 22, such as a hook or hook-shaped member, configured to hold the draw cord 11; (c) a primary engager or first engager 24 configured to engage the cord holder 22; (d) a secondary engager or second engager 26 configured to engage the cord holder 22 or support 20; (e) a shaft, pivot member or axle 28 supported by the support 20 and configured to extend at least partially into the first and second engagers 24, 26; (f) a coupler 30 configured to bind the engagers 24, 26 together so that the engagers 24, 26 are statically positioned relative to each other; and (g) a securement member 33 configured to lock or unlock the position of the first engager 24 relative to the cord holder 22 or support 20. In the embodiment shown, the support 20 supports the cord holder 22, the first engager 24, the second engager 26, the axle 28, and the coupler 30. The support 20 can be non-moveably or fixedly connected to the body 12, or the support 20 can be moveably or pivotally coupled to the body 12, such as through the use of a pin, bolt, screw, joint or other suitable fastener.

The cord holder 22 is moveably or pivotally coupled to the support 20, and the cord holder 22 is configured to selectively engage the draw cord 11. In some embodiments, the cord holder 22 includes a grasp, hook, notch, peg or other protrusion capable of retaining the draw cord 11 while the user keeps the draw cord 11 in the drawn condition DC (FIG. 1) before shooting.

The engagers 24, 26 define pivot channels 25, 27, respectively, and the pivot channels 25, 27 extend along a pivot axis 29. The pivot channels 25, 27 are configured to receive opposite ends of the axle 28. The engagers 24, 26 also define coupler channels 37, 38, respectively, and the coupler channels 37, 38 extend along a coupling axis 41. The coupler channels 37, 38 are configured to receive opposite ends of the coupler 30. Depending upon the embodiment, the coupler 30 can include a screw, bolt, pin (threaded or unthreaded), rod (threaded or unthreaded), magnetic element or other suitable fastener, binder or synchronizer. In an embodiment, an end of coupler 30 is threaded and configured to be threadably engaged with a threaded portion of at least one of the engagers 24, 26.

With continued reference to FIG. 4A, the first engager 24 and the second engager 26 are supported by the support 20 and are configured to independently engage the cord holder 22. In an embodiment, the engagers 24, 26 enable the user to independently adjust: (a) the foreshadowing notice time point at which the archery release device 10 provides a foreshadowing output, alert or notice to the user that the release of the draw cord 11 is imminent or forthcoming; and (b) the release time point at which the archery release device 10 releases the draw cord 11, resulting in the release event. Depending upon the embodiment, the foreshadowing notice can include an audible output, such as a click or snap sound, a tactile output, such as a vibration, or a combination thereof.

In the cord hold condition or drawn condition DC (FIG. 1) of the archery release device 10, the first engager 24 is in physical contact with the cord holder 22 so as to interfere with the pivoting of the cord holder 22. When the user generates the release force, the cord holder 22 slides past the first engager 24 until the cord holder 22 is freed from the interference, resulting in the foreshadowing notice described above. The foreshadowing notice alerts the user to the fact that a release force has just been generated, which will soon result in a release of the draw cord 11. There is a notice period between the foreshadowing notice and the release time point. In other words, the notice period is the time between the foreshadowing notice time point and the release time point. The notice period enables the user to prepare for the imminent release event, for example, by using enhanced aiming concentration, breathing control or body control.

In the drawn condition DC of the archery release device 10, the second engager 26 is also in physical contact with the cord holder 22 so as to interfere with the pivoting of the cord holder 22. In an embodiment, the draw cord engagement system 14 is configured so that the user can offset the angular position of the second engager 26 from the angular position of the first engager 24. As a result, when the release force occurs, first the first engager 24 disengages the cord holder 22, and a moment (e.g., a split second) later, the second engager 26 disengages the cord holder 22 at the release time point. Next, the archery release device 10 transitions to the released or undrawn condition UC (FIG. 2). The foregoing method therefore involves an advance warning, preparation or notice period between: (a) the foreshadowing notice time point when the first engager 24 disengages the cord holder 22; and (b) the release time point when the second engager 26 disengages the cord holder 22.

The draw cord engagement system 14 is configured to enable the user to adjust a first setting or notice time point setting associated with the foreshadowing notice time point (and, hence, the notice period) without changing a second setting or release time point setting associated with the release time point and release event. Likewise, the draw cord engagement system 14 is also configured to enable the user to adjust the release time point setting associated with the release time point (and, hence, the release event) without changing the notice time point setting associated with the notice time point (and, hence, the notice period). This independent adjustment provides an important advantage and improvement by avoiding the loss of user settings during fine tuning of the archery release device 10.

Figure 4C:
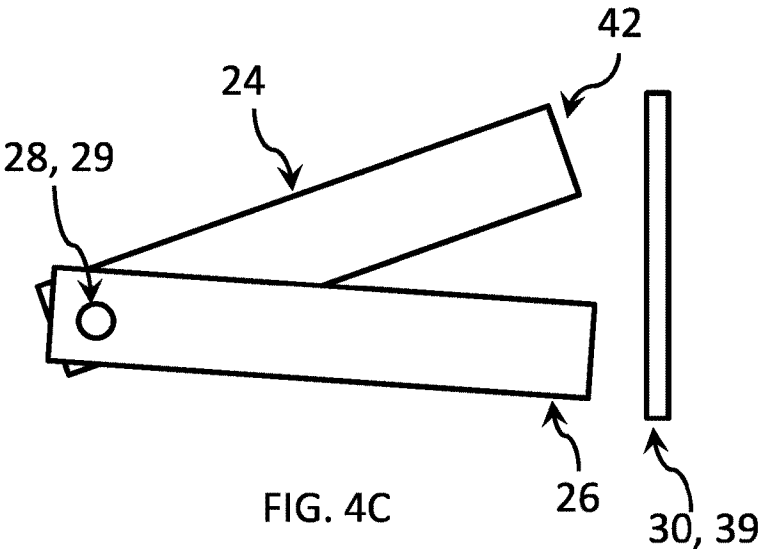
FIG. 4C is a schematic diagram illustrating a decoupling position of the draw cord engagement system of FIG. 4A.
Figure 4D:
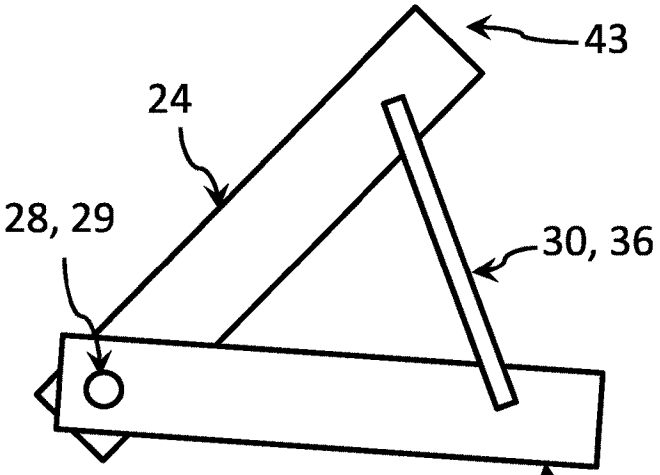
FIG. 4D is a schematic diagram illustrating a coupling position of the draw cord engagement system of FIG. 4A, showing the first and second engagers in a second positional relationship that differs from the first positional relationship shown in FIG. 4B.
Figure 4B:
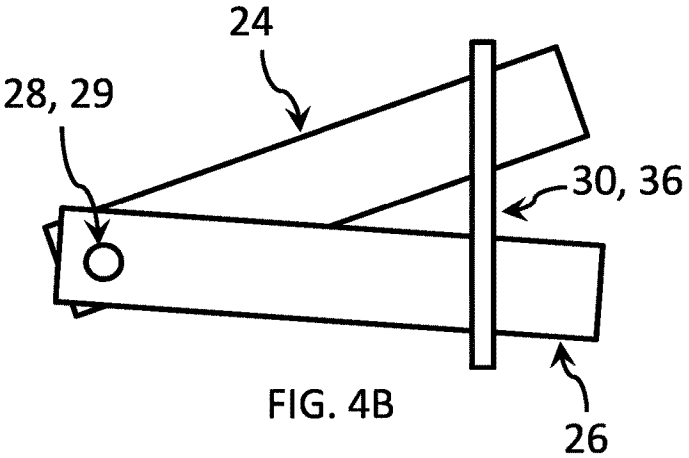
FIG. 4B is a schematic diagram illustrating a coupling position of the draw cord engagement system of FIG. 4A, showing the first and second engagers in a first positional relationship.

For example, referring to FIGS. 4B-4D, a notice adjustment mode involves the following steps for a first repositioning:

(a) The user loosens, removes or otherwise manipulates the coupler 30, transitioning the coupler 30 from an active condition or coupling position 36 to an inactive condition or decoupling position 39. When the coupler 30 is in the coupling position 36, the coupler 30 is operable to secure the engagers 24, 26 in a static position relative to each other, resulting in a positional relationship between the engagers 24, 26. In the positional relationship, the engagers 24, 26 are spatially fixed together so that the movement of the engagers 24, 26 is synchronized, moveable as a unit or unitarily about the pivot axis 29. In the decoupling position 39 (such as, when the coupler 30 is removed from one or both of the engagers 24, 26) the coupler 30 is not operable to cause the first and second engagers 24, 26 to be unitarily moveable about the pivot axis 29. In other words, when the coupler 30 is in the decoupling position 39 (FIG. 4C), the first and second engagers 24, 26 are free to independently pivot about the pivot axis 29, changing their angular positions relative to each other.

(b) While the coupler 30 is in the decoupling position 39, the user rotates or pivots the first engager 24 about the pivot axis 29 relative to the cord holder 22 or support 20 while, in this example, the second engager 26 remains in a fixed position relative to the cord holder 22 or support 20. In this example, the user moves the first engager 24 from the angular position 42 (FIG. 4C) to the angular position 43 (FIG. 4D). To do so, user pivots the first engager 24 until reaching the desired angular position 43 associated with a desired foreshadowing notice time point and corresponding notice period. As shown, the difference between angular positions 42 and 43 provides a spatial offset between the engagers 24, 26, which determines the notice period.

(c) Next, the user inserts, tightens or otherwise manipulates the coupler 30, transitioning the coupler 30 from the decoupling position 39 to the coupling position 36, as shown in FIG. 4D.

This enables the user to adjust the setting for the foreshadowing notice time point according to the user's preference without altering the setting for the release time point.

In another example, referring back to FIG. 4A, a release time point adjustment mode involves the following steps for a second repositioning while the coupler 30 is in the coupling position 36:

(a) The user loosens, removes or otherwise manipulates the securement member 33, transitioning the securement member 33 from an active condition or lock position 45 to an inactive condition or unlock position 51. In the lock position 45, the securement member 33 is operable to secure, fix or lock the position of the first engager 24 (together with the coupled second engager 26) relative to the cord holder 22 or support 20. In the unlock position 51, securement member 33 is operable to enable the user to unitarily move the first and second engagers 24, 26 (while bound together in the coupled position 36) relative to the cord holder 22 or support 20.

(b) While the securement member 33 is in the unlock position 51, the user pivots the unified first and second engagers 24, 26 (as a unit) about the pivot axis 29 relative to the cord holder 22 or support 20. During this pivoting, the coupler 30 keeps the engagers 24, 26 coupled together, avoiding movement of the first engager 24 relative to the second engager 26. The user continues the pivoting until reaching a desired angular position associated with a desired release time point for the release of the cord 11.

(c) Next, the user inserts, tightens or otherwise manipulates the securement member 33, transitioning the securement member 33 from the unlock position 51 to the lock position 45.

The foregoing steps and configuration enable the user to adjust the release time point according to the user's preference without altering the notice time point, providing a substantial improvement and advantage. For example, by pivoting the unified or coupled engagers 24, 26 downward, the user can decrease the angle of contact between the first engager 24 and the cord holder 22 from a first contact angle to a second contact angle. This can cause the draw cord engagement system 14 to release the draw cord 11 at a release time point that is earlier than the release time point associated with the first contact angle.

With continued reference to FIG. 4A, in an embodiment, the coupler 30 includes a head (not shown) that defines a slot or tool receiver. The tool receiver is configured to receive a tool for rotating the coupler 30. The rotation of coupler 30 in different directions is operable to interchangeably bind or unbind the engagers 24, 26 with respect to one another. To bind first and second engagers 24, 26 together to form a single assembly or unit, the coupler 30 is rotated clockwise by the user. This rotation drives the coupler 30 into the first coupler channel 38 within the first engager 24 and then into the second coupler channel 37 within the second engager 26. Conversely, when the user chooses to unbind the first and second engagers 24, 26, such as when the user seeks to adjust the foreshadowing notice time point, the user rotates the coupler 30 counter-clockwise until the coupler 30 is no longer within at least one of the first and second coupler channels 37, 38.

Figure 5:
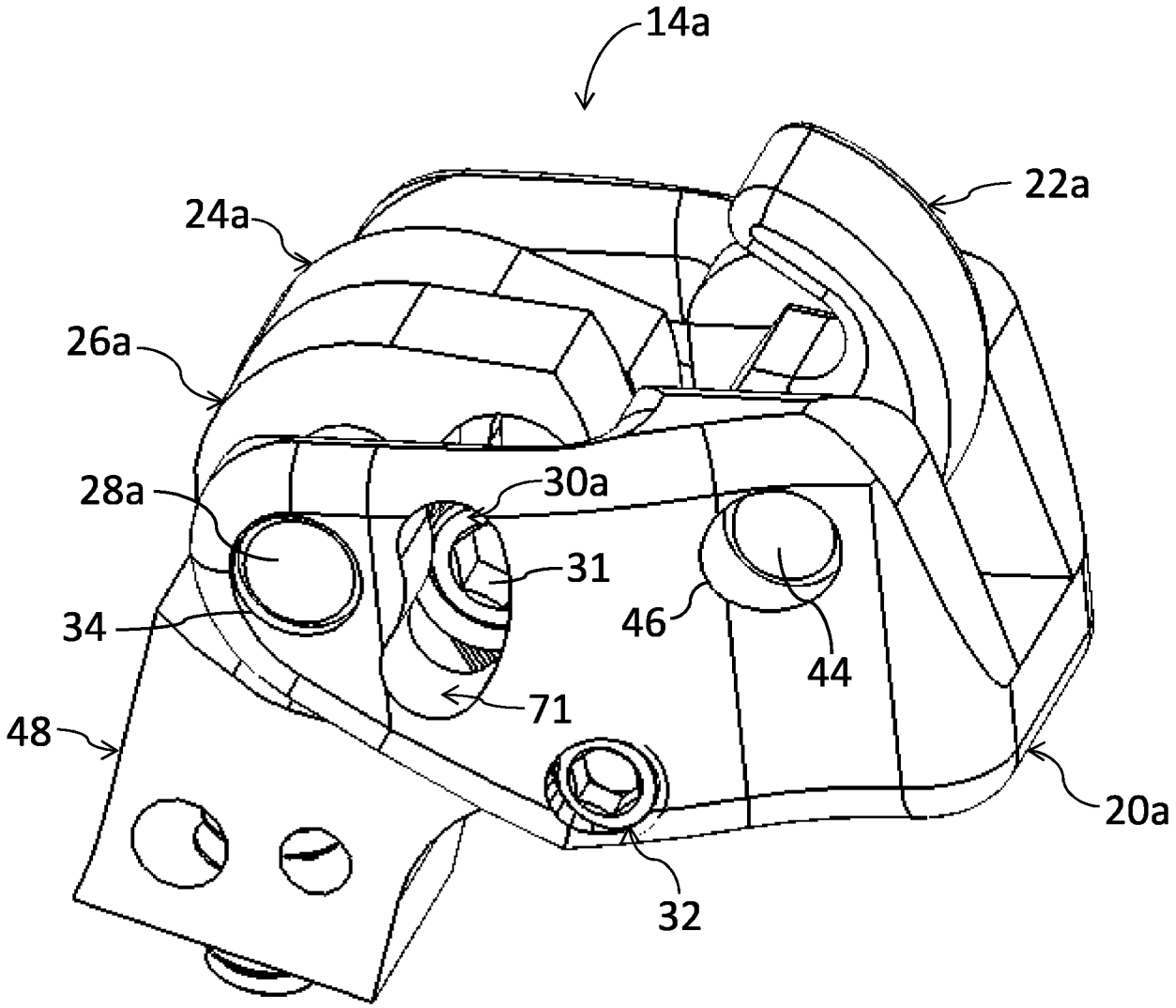
FIG. 5 is an enlarged, top isometric view of an embodiment of a draw cord engagement system.
Figure 13:
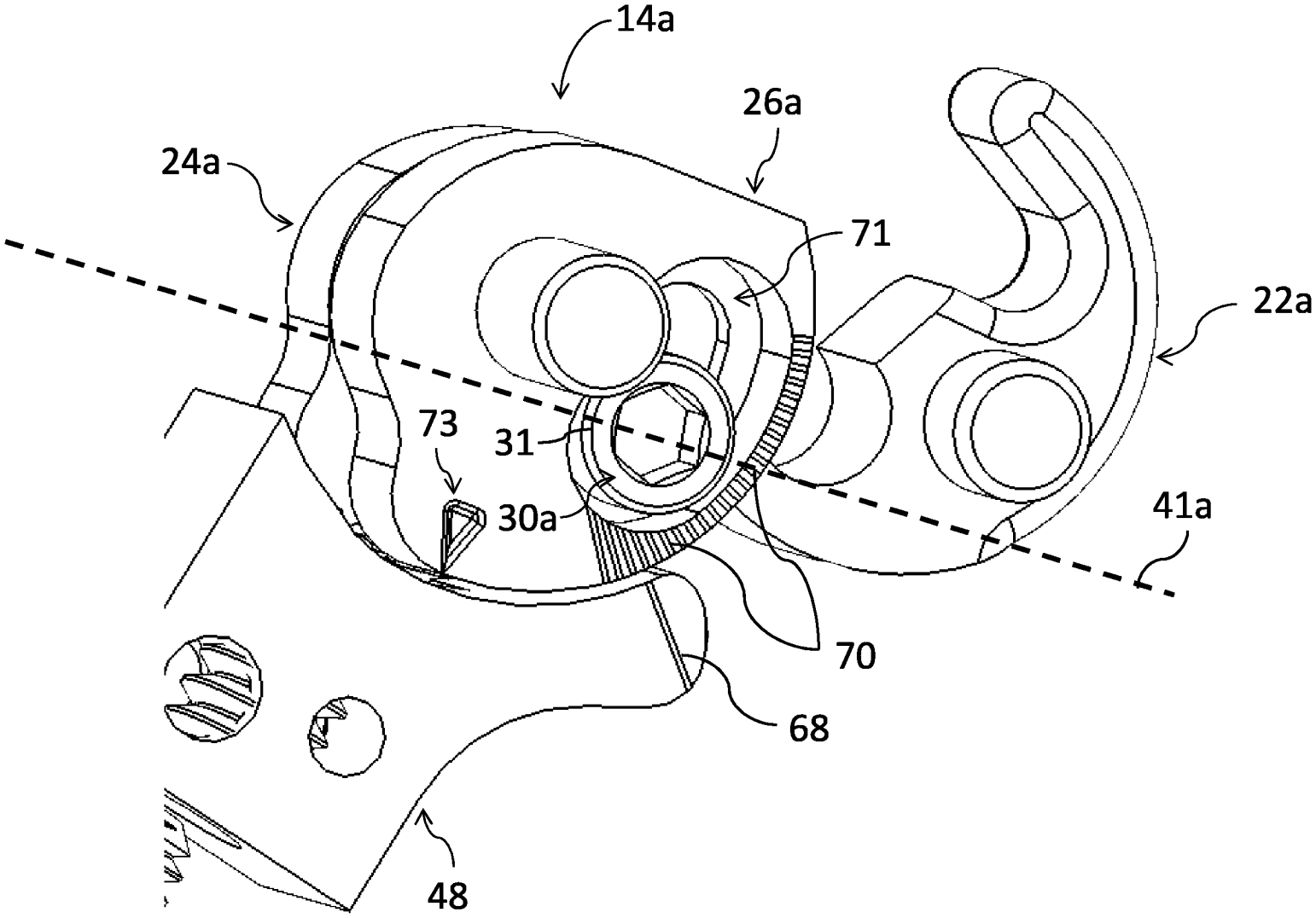
FIG. 13 is an enlarged, side isometric view of an embodiment of the first engager, second engager and cord holder of the draw cord engagement system of FIG. 5, illustrating the adjustment slot defined by the second engager.

As illustrated in FIG. 5, in an embodiment, the draw cord engagement system 14*a* includes: (a) a cord holder 22*a* configured to be hooked onto the draw cord 11; (b) a carriage, base or support 20*a* pivotally coupled to body 12 (FIG. 2); (c) a first engager 24*a* configured to interfere with and engage the cord holder 22*a*; (d) a second engager 26*a* configured to interfere with and engage the cord holder 22*a*; (e) a pivot member or axle 28*a* that extends at least partially through each of the engagers 24*a*, 26*a*; and (f) a coupler 30*a*, having a coupler head 31, that extends along the coupling axis 41*a* (FIG. 13).

Figure 6:
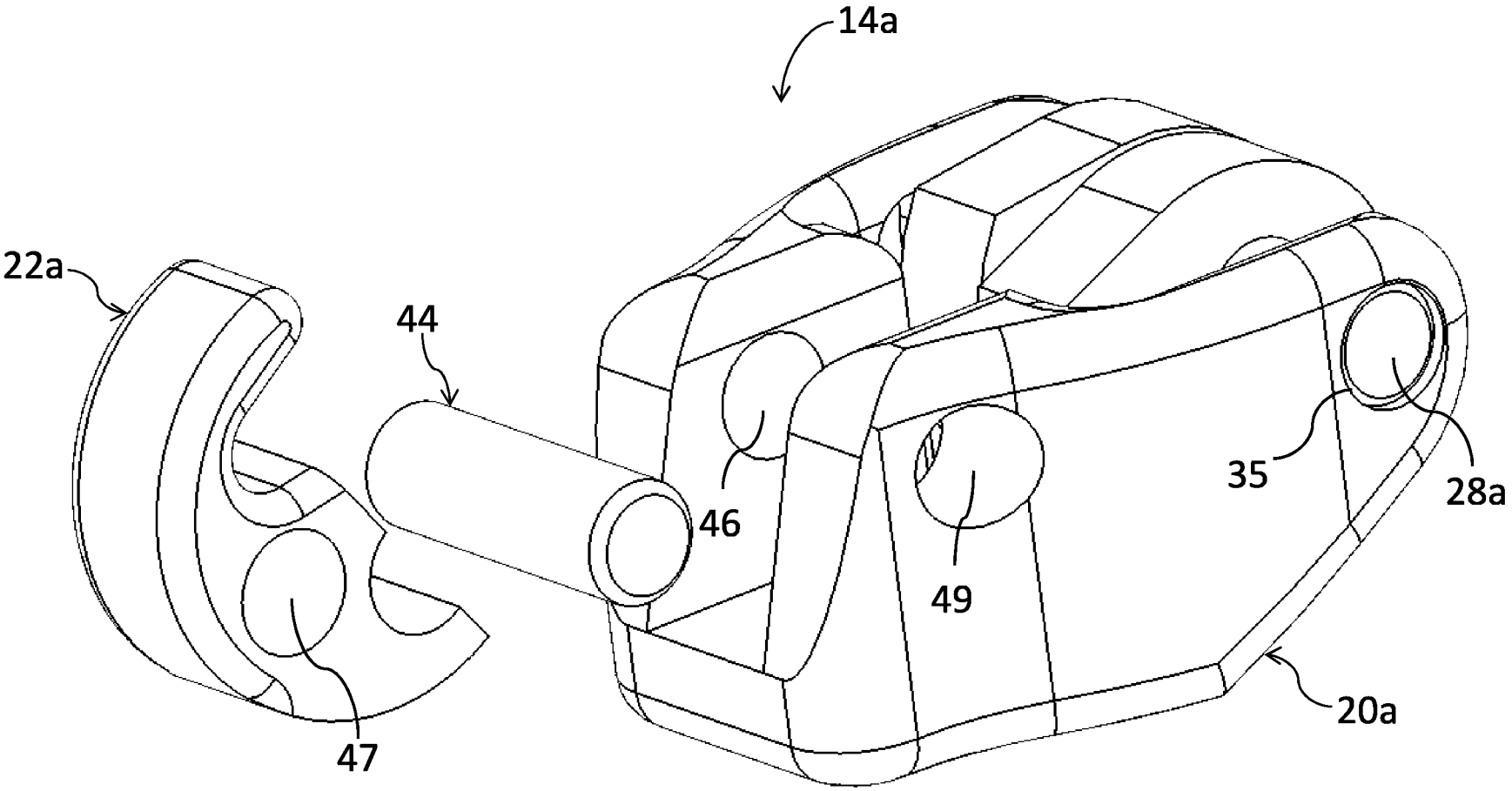
FIG. 6 is an enlarged, exploded, front isometric view of the draw cord engagement system of FIG. 5.

The first engager 24*a* and second engager 26*a* are pivotally supported by the axle 28*a*. The axle 28*a*, supported by the support 20*a*, is positionable and insertable in the support opening 34 and the support opening 35 (FIG. 6). In an embodiment, the support 20*a* is removably secured to the draw cord engagement system 14*a* by a fastener 32, such as a threaded screw, bolt, pin, joint or other suitable fastener.

As illustrated in FIG. 5-6, the cord holder 22*a* is pivotally connected to the support 20*a* by a cord holder support or cord holder axle 44. The cord holder axle 44 is disposed within support openings 46, 49, each of which is defined by the support 20*a*, and the cord holder axle 44 extends through a cord holder passageway 47 that extends entirely through the cord holder 22*a*. Depending upon the embodiment, the cord holder axle 44 can include one or more shaft members, pivot members or pins.

Figure 7:
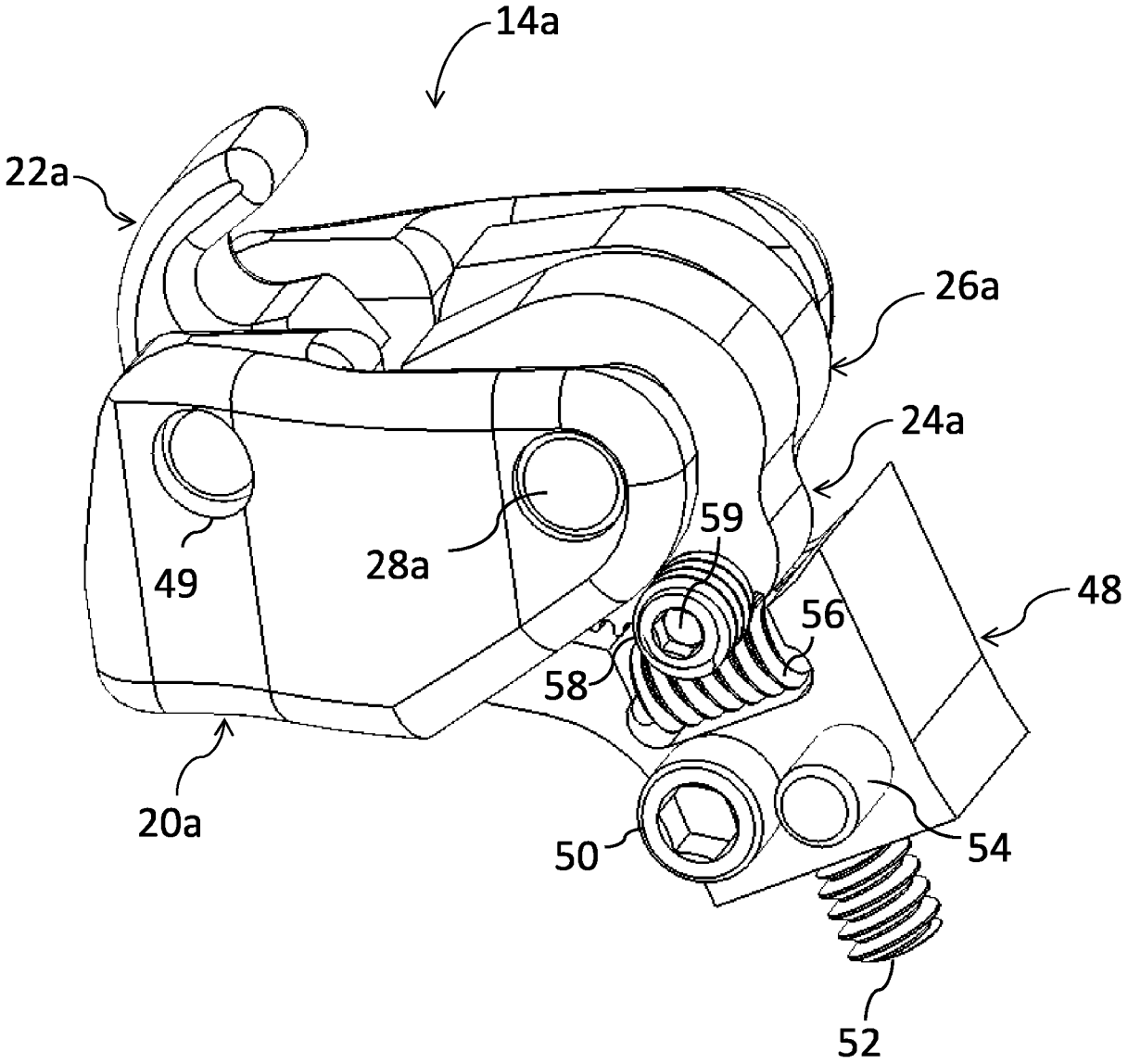
FIG. 7 is an enlarged, side isometric view of the draw cord engagement system of FIG. 5.
Figure 8:
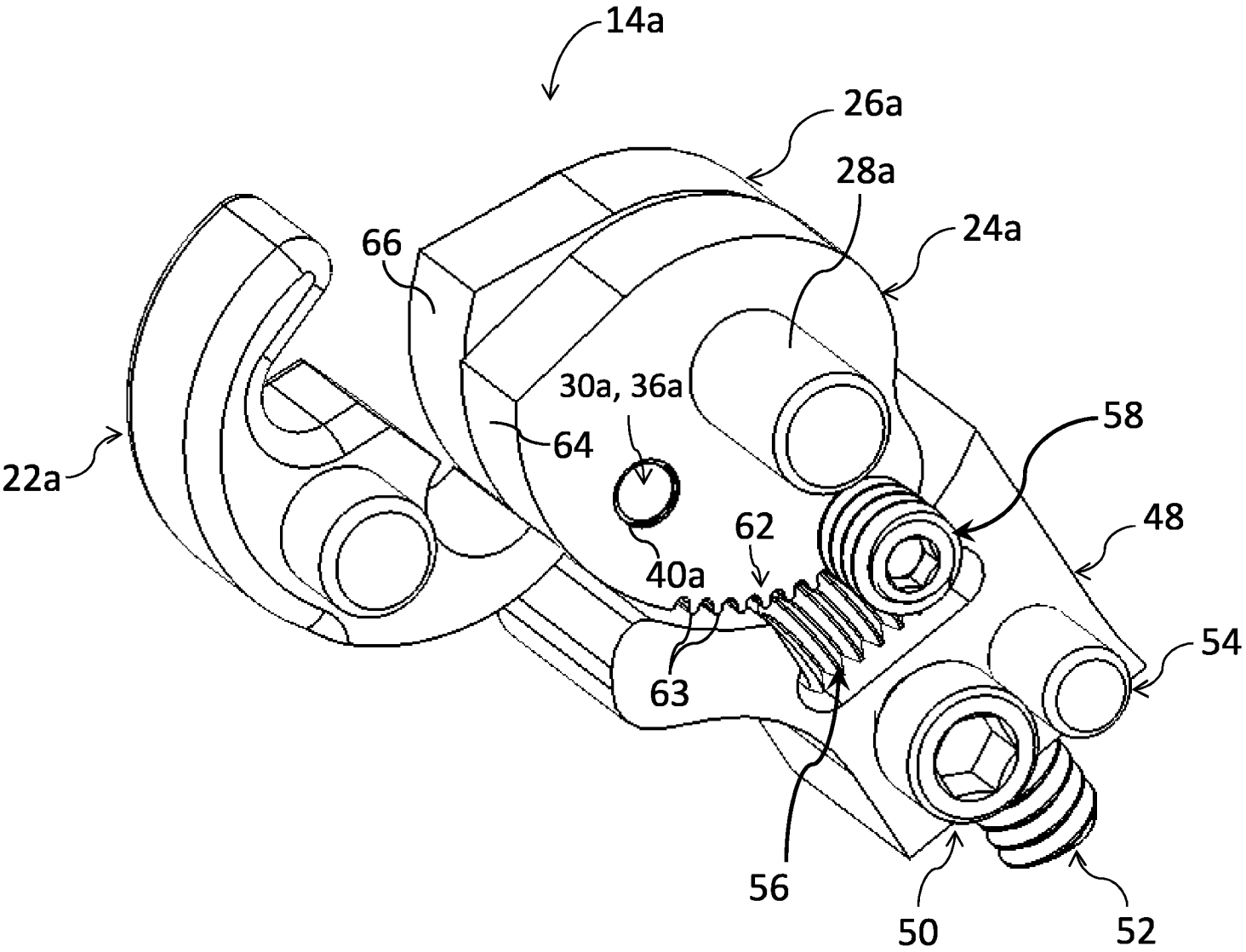
FIG. 8 is an enlarged, side isometric view of the draw cord engagement system of FIG. 5 shown with the support removed.

As illustrated in FIGS. 7-8, the support 20*a* is separable from the draw cord engagement system 14*a*. As shown, the draw cord engagement system 14*a* includes a neck 48 that is connectable to the body 12 (FIG. 2). Depending upon the embodiment, the neck 48 can include one or more bolts, screws, pins, joints, fasteners or a combination thereof to connect the neck 48 to the body 12. In the embodiment shown in FIGS. 7-8, the neck 48 includes a support fastener 50, screw 52 and pin 54. The support fastener 50 is configured to extend through the neck 48 and the body 12, thereby coupling the neck 48 to the body 12. The screw 52 may be used to fasten the neck 48 to the body 12. The pin 54 may releaseably engage the body 12 to prevent the draw cord engagement system 14*a* from disconnecting from the body 12, providing further stability to the archery release device 10.

Figure 9:
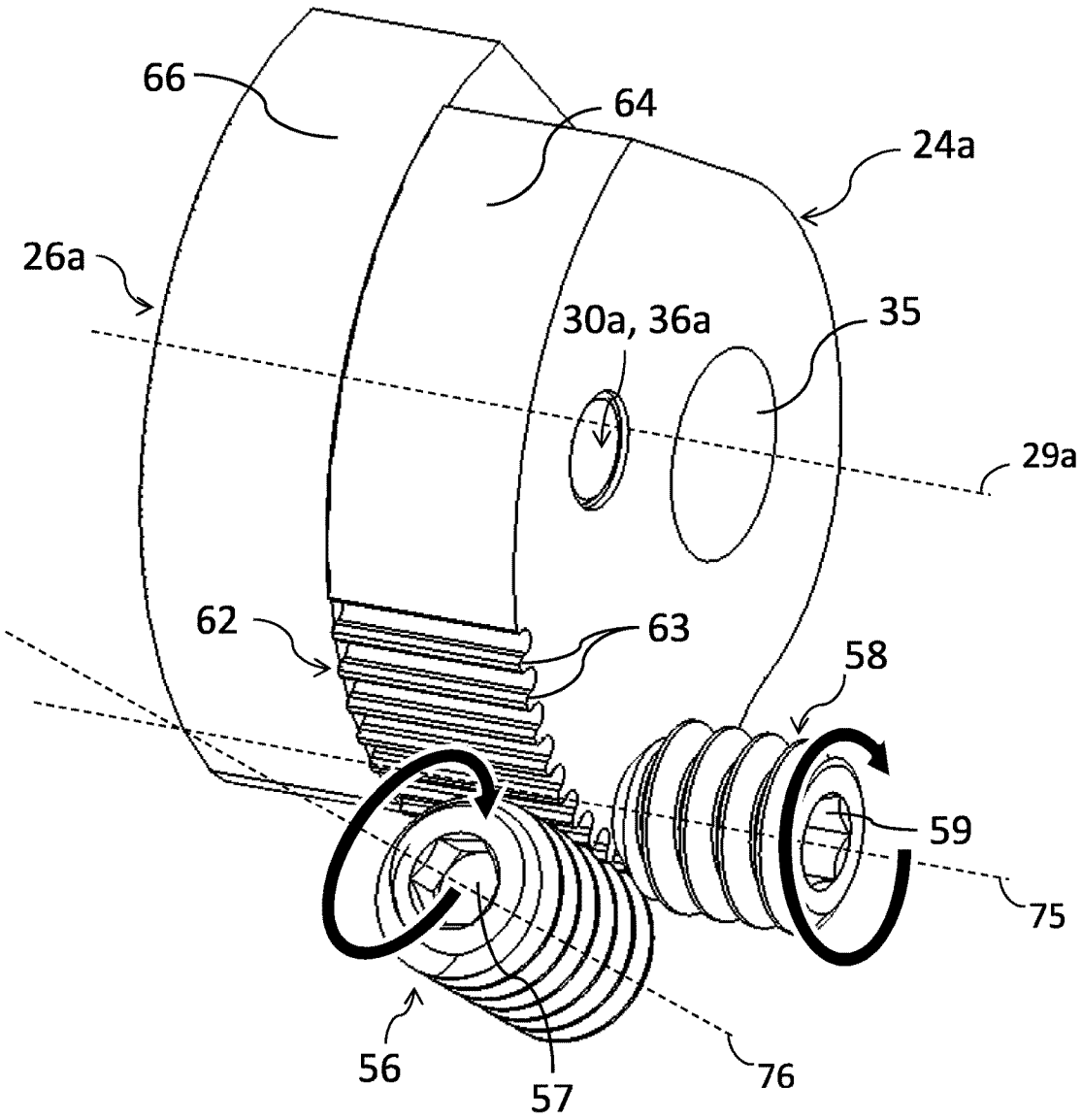
FIG. 9 is an enlarged, rear isometric view of an embodiment of the first and second engagers of the draw cord engagement system of FIG. 5.

As shown in FIGS. 7-8, the neck 48 also supports the setting drive member 56 and the securement member 58. As shown in FIG. 9, the setting drive member 56 extends along axis 76, and the securement member 58 extends along axis 75. In this embodiment, the setting drive member 56 has a helical surface defined by winding grooves or a plurality of threads. The setting drive member 56 also has a tool receiver 57 defining a slot configured to receive an end of a wrench or tool. Similarly, the securement member 58 has a helical surface defined by winding grooves or a plurality of threads. The securement member 58 also has a tool receiver 59 defining a slot configured to receive an end of a wrench or tool. The securement member 58 may be accessed through the bore 90 of the body 12 (FIG. 3) and the port 92 of neck 48 (FIG. 3).

As shown in FIG. 8-9, the first engager 24*a* has a drive interface 62. The drive interface 62 has a plurality of teeth 63 spaced apart from each other. The teeth 63 can include ridges, detents, protrusions, a series of peaks and valleys, or other suitable engagement members. As shown in FIG. 8-9, the threads of the setting drive member 56 are mated with or otherwise engaged with the teeth 63 of the drive interface 62. Consequently, the rotation of the setting drive member 56 applies a drive force to the first engager 24*a*, causing the first engager 24*a* to pivot about the pivot axis 29*a*.

Figures 10A, 10B:
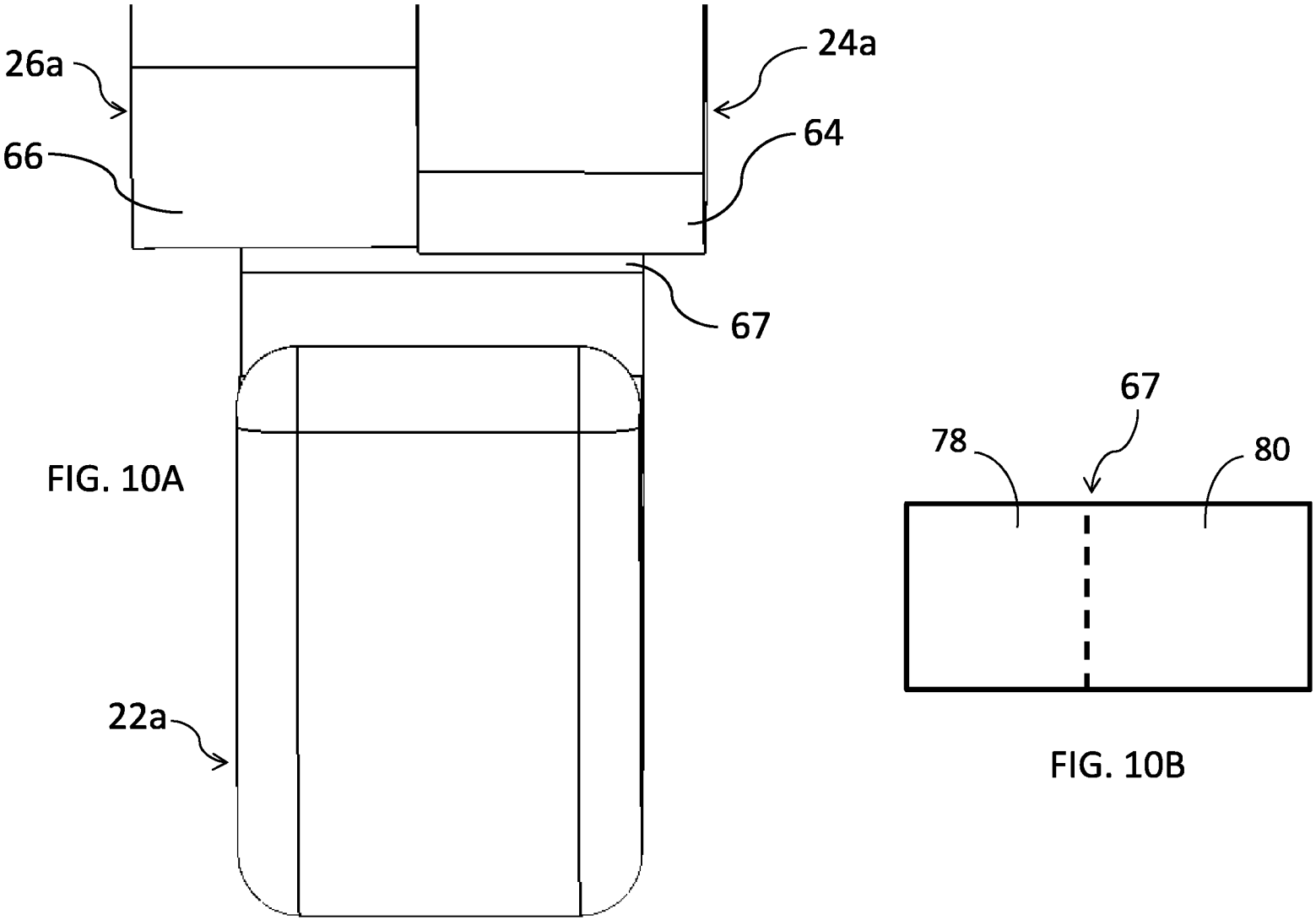
FIG. 10A is an enlarged top view of an embodiment of the first and second engagers of the draw cord engagement system of FIG. 5, illustrating the interfaces between the first engager, second engager and cord holder.
FIG. 10B is an enlarged top view of an embodiment of the holder engagement surface of the draw cord engagement system of FIG. 5.
Figure 11:
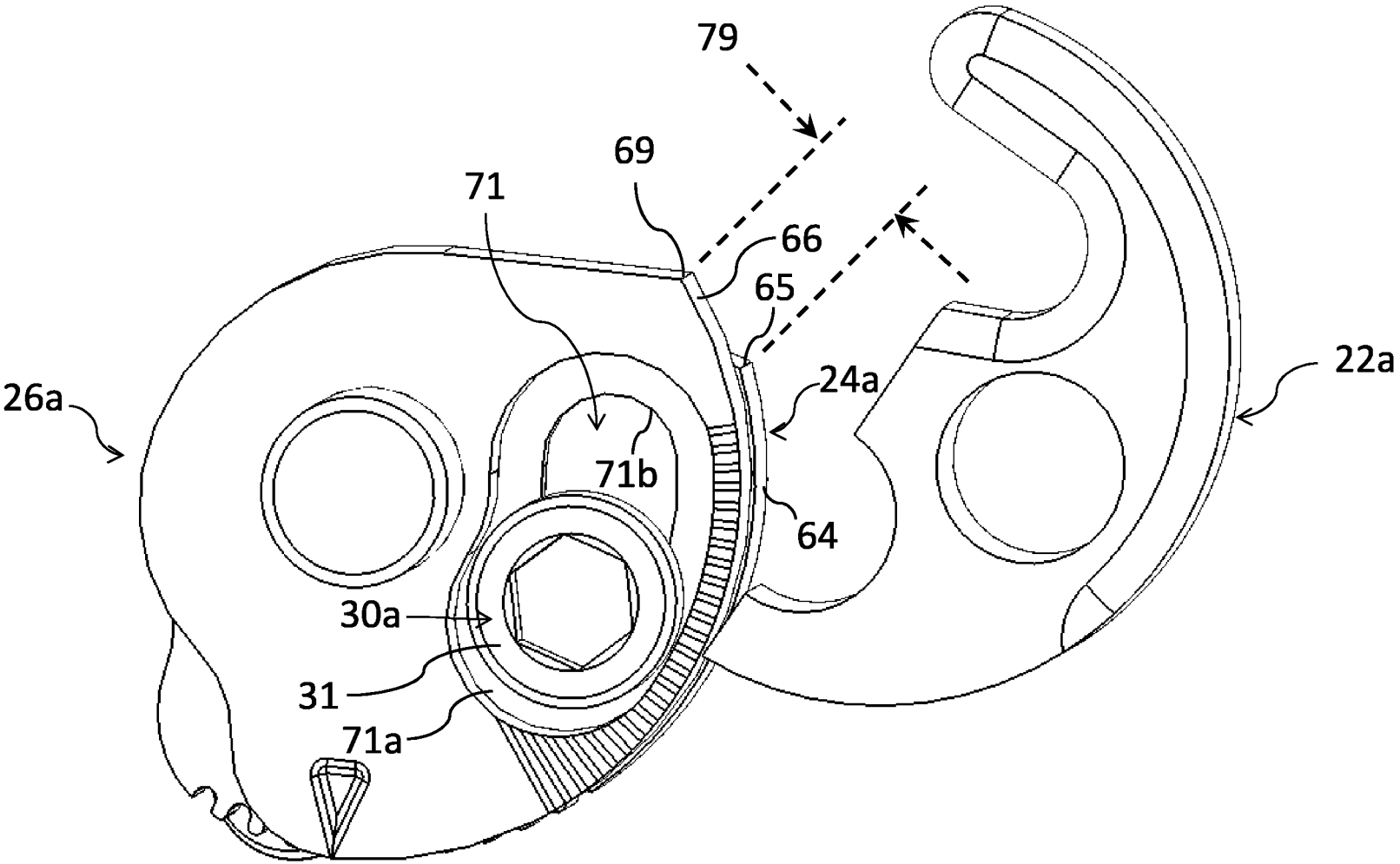
FIG. 11 is an enlarged side view of an embodiment of the first engager, second engager and cord holder of the draw cord engagement system of FIG. 5, illustrating the adjustment slot defined by the second engager.

With reference to FIGS. 10A, 10B and 11, the first engager 24*a* includes a first engagement interface 64, and the second engager 26*a* includes a second engagement interface 66. The interfaces 64, 66 each include an arc-shaped face or arc-shaped surface configured to make physical contact with the holder engagement surface 67 of the cord holder 22*a*. For a period of time during the drawn condition DC (FIG. 1), the holder engagement surface 67 is in contact with both of the first and second engagement interfaces 64, 66. In particular, the primary surface 80 of the holder engagement surface 67 is in contact with first engagement interface 64 of the first engager 24*a*, and the secondary surface 78 of the holder engagement surface 67 is in contact with the second engagement interface 66 of the second engager 26*a*.

With continued reference to FIGS. 10A, 10B and 11, at the beginning of the drawn condition DC, the primary surface 80 is in contact with the first engagement interface 64, and the secondary surface 78 is in contact with the second engagement surface 66. As further shown, the position of the first engager 24*a* is offset from the position of the second engager 26*a*, resulting in a spatial offset 79 (FIG. 11). As the user generates a release force, the holder engagement surface 67 of the cord holder 22*a* slides along the first and second engagement surfaces 64, 66. Eventually, the holder engagement surface 67 slides past the primary edge 65 (FIG. 11) of the first engagement surface 64 and is freed from the first engager 24*a*, resulting in a foreshadowing notice, such as a click sound, that is perceptible to the user. This enables the user to prepare for the imminent release, for example, by using enhanced aiming concentration, breathing control or body control. The foreshadowing notice occurs at the same time or substantially at the same time as the notice time point. Spatially, the notice position corresponding to the notice time point is the position of the primary edge 65 at the moment when the primary edge 65 disengages from the primary surface 80 of the holder engagement surface 67 of the cord holder 22*a*.

While the user uses the notice period to prepare, as described above, the release force causes the second engagement surface 66 to become freed from the second engager 26*a*, resulting in the release event. Specifically, the secondary surface 78 slides past the secondary edge 69 (FIG. 11) of the second engagement surface 66, freeing the cord holder 22*a* from the second engager 26*a*. This causes the cord holder 22*a* to release the draw cord 11 (FIG. 1), which then propels the projectile 13 (FIG. 1) forward in a direction away from the user. The release time point occurs at the same time (or substantially at the same time) as when the cord holder 22*a* slides past the secondary edge 69. Spatially, the release position corresponding to the release time point is the position of the secondary edge 69 when the secondary edge 69 disengages from the cord holder 22*a*.

Figure 12:
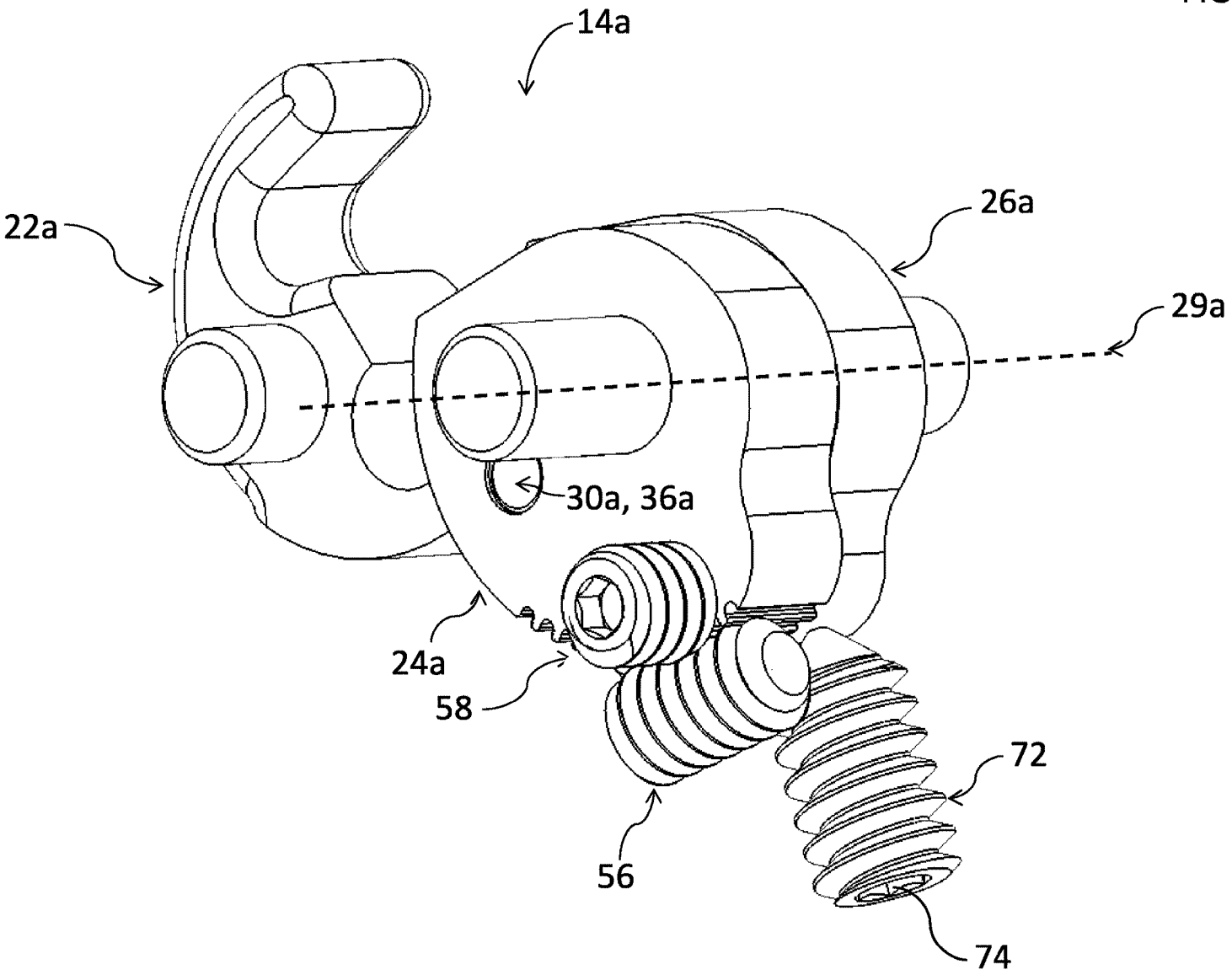
FIG. 12 is an enlarged, rear isometric view of an embodiment of the first engager, second engager, cord holder, setting drive member, and supplement securement member of the draw cord engagement system of FIG. 5.

In the embodiment illustrated in FIG. 12, the draw cord engagement system 14*a* includes a supplemental securement member 72. The supplemental securement member 72 is configured to prevent or inhibit movement of the second engager 26*a* about the pivot axis 29*a*. When the first and second engagers 24*a*, 26*a* are unbound in the uncoupling position described above, the user can untighten the supplemental securement member 72 to fix the position of the the second engager 26*a* relative to the support 20*a*. As described below, this enables the user to adjust the position of the first engager 24*a* relative to the second engager 26*a*. When the first and second engagers 24*a*, 26*a* are bound together in the coupling position 36*a*, the supplemental securement member 72 is configured to prevent or inhibit the movement of both the first and second engagers 24*a*, 26*a* relative to the cord holder 22*a* or support 20*a*. The supplemental securement member 72 may have a helical surface defined by winding grooves or a plurality of threads. The supplemental securement member 72 also has a tool receiver or slot 74 configured to receive an end of a wrench or tool. The supplemental securement member 72 may be accessed through the bore 90 of the body 12 (FIG. 3) and the port 92 (FIG. 2) of the neck 48 (FIG. 5).

As illustrated in FIG. 12, the coupler 30*a* is configured to be transitioned to the decoupling position (not shown), wherein the user has removed the coupler 30*a* from at least one of the first and second engagers 24*a*, 26*a*. In such decoupling position: (a) the first engager 24*a* is moveable relative to the second engager 26*a*; (b) the securement member 58 is loosened to disengage the first engager 24*a*; (c) the supplemental securement member 72 is adjusted to secure the second engager 26*a* in fixed position relative to the support 20*a*; and (d) the rotation of setting drive member 56 causes both the first engager 24*a* to pivot about the pivot axis 29*a* (FIG. 9) relative to the second engager 26*a*.

Further, as illustrated in FIG. 12, when the coupler 30*a* is installed in the coupling position 36*a* (FIGS. 8-9): (a) the first and second engagers 24*a*, 26*a* are unified or otherwise bound together; (b) the securement member 58 is loosened to disengage the first engager 24*a*; (c) the supplemental securement member 72 is loosened to disengage the second engager 26*a*; and (d) the rotation of setting drive member 56 causes both the first and second engagers 24*a*, 26*a* to pivot, as an assembly or unit, about the pivot axis 29*a* (FIG. 9).

As described above, advantageous features of the archery release device 10 include the independence of adjustment of the notice time point and release time point. This independent adjustment functionality avoids the loss of user settings during fine tuning of the archery release device 10.

Referring to FIGS. 5, 12 and 13, the adjustment of the notice time point in a notice time point adjustment mode involves, in an example, the following steps:

(a) a loosening of the coupler 30*a* and the securement member 58 by the user;

(b) a rotation of the setting drive member 56 causing a pivoting of the first engager 24*a* about the pivot axis 29*a* relative to the cord holder 22*a* or support 20*a* while the second engager 26*a* remains in a fixed position relative to the support 20*a* (secured by the supplemental securement member 72);

(c) a stopping of such rotation when the user has moved the first engager 24*a* to a desired angular position corresponding to a desired notice time point; and (d) a tightening of the securement member 58 and the coupler 30*a* into the first coupler channel 38*a*, resulting in a notice setting.

As illustrated in FIG. 13, during the notice time point adjustment mode, the coupler head 31 is moveable relative to the second engager 26*a* after the coupler 30*a* has been loosened. In the embodiment shown, the second engager 26*a* defines an arc-shaped, elongated adjustment slot 71, as illustrated in FIGS. 5, 11 and 13. The coupling axis 41*a* intersects or otherwise extends through the elongated adjustment slot 71. The arc length of the adjustment slot 71 corresponds to the limits of the notice time point adjustment. For example, the lower slot end 71*a* and upper slot end 71*b*, shown in FIG. 11, limit the extent to which the first engager 24*a* can be pivoted or rotated relative to the second engager 26*a*. This is because the coupler 30*a* remains within the first engager 24*a* and the second engager 26*a* during the notice time point adjustment mode.

Referring to FIG. 12, the adjustment of the release time point in a release time point adjustment mode involves, in an example, the following steps:

(a) a loosening of the securement member 58 and the supplemental securement member 72 by the user;

(b) a rotation of the setting drive member 56, consequently pivoting the first and second engagers 24*a*, 26*a* (as an assembly or unit) about the pivot axis 29*a* relative to the cord holder 22*a* or support 20*a* while the coupler 30*a* keeps the engagers 24*a*, 26*a* bound together in a coupling position 36*a*, avoiding movement of the first engager 24*a* relative to the second engager 26*a;*

(c) a stopping of such rotating when the user moves the the secondary edge 69 (FIG. 11) to a desired position relative to the cord holder 22*a* or support 20*a* (FIG. 7); and (d) a tightening of the securement member 58 and the supplemental securement member 72 by the user, resulting in a release point setting.

In the embodiment shown in FIG. 13, the neck 48 of the draw cord engagement system 14*a* includes a line, pointer or marker 68. The marker 68 corresponds to: (a) the position marking set, array or adjustment indicator set 70 visible on the second engager 26*a*; and (b) the supplemental indicator 73 also visible on the second engager 26*a*. The marker 68, adjustment indicator set 70 and the supplemental indicator 73 assist the user in incrementally controlling the settings for the variable notice time points and the release time points of archery release device 10. It should be appreciated that, in other embodiments, the adjustment indicator set 70 may be located on the first engager 24*a*, and the marker 68 maybe located on a corresponding portion of the neck 48.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with or otherwise interlock with each other.}

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A draw cord engagement system comprising:

a support;

a cord holder moveably coupled to the support, wherein the cord holder is configured to hold a draw cord;

a first engager moveably coupled to the support, wherein the first engager is configured to engage the cord holder;

a second engager moveably coupled to the support, wherein:

the second engager is configured to engage the cord holder; and the second engager is configured to be repositioned relative to the first engager; and a coupler configured to couple the first engager to the second engager, wherein the cord holder, the first engager, the second engager and the coupler are configured to cooperate with each other to enable:

a first repositioning of the first engager relative to the second engager, wherein the first repositioning results in a first setting associated with a notice period; and a second repositioning of at least the second engager relative to the support without causing a change in the first setting, wherein the second repositioning results in a second setting associated with a release event, wherein during the second repositioning, the first and second engagers are configured to unitarily move relative to the cord holder, wherein the first engager, the second engager, and the cord holder remain coupled to the support during the first and second repositionings, and wherein, in response to a force applied to the cord holder, the cord holder is configured to:

disengage the first engager;

then engage with the second engager; and then disengage the second engager to enable the cord holder to release the draw cord, resulting in the release event.

2. The draw cord engagement system of claim 1, wherein the coupler is configured to be transitioned between: (a) a decoupling position in which the first and second engagers are moveable independently of each other; and (b) a coupling position in which the coupler causes the first and second engagers to be statically positioned relative to each other, resulting in a positional relationship.

3. The draw cord engagement system of claim 2, wherein the decoupling position enables the first repositioning.

4. The draw cord engagement system of claim 3, wherein, in the coupling position, the coupler is configured to be: (a) at least partially inserted into the first engager; and (b) at least partially inserted into the second engager.

5. The draw cord engagement system of claim 3, comprising a securement member configured to be transitioned between: (a) an unlock position in which the first and second engagers are moveable relative to the support while the first and second engagers comprise the positional relationship; and (b) a lock position in which the securement member positionally fixes the first and second engagers relative to the support while the first and second engagers comprise the positional relationship.

6. The draw cord engagement system of claim 5, wherein the unlock position enables the second repositioning.

7. The draw cord engagement system of claim 1, wherein the release event occurs at a release time point after the notice period, wherein the cord holder, the first engager, the second engager and the coupler are configured to cooperate with each other to enable the notice period to be adjusted without affecting the release time point.

8. The draw cord engagement system of claim 7, wherein:

the first engager defines a first coupler channel;

the second engager defines a second coupler channel;

the coupler is configured to extend along a coupling axis; and the coupling axis extends through the first and second coupler channels.

9. The draw cord engagement system of claim 8, wherein the second engager defines an adjustment slot that is intersected by the coupling axis.

10. The draw cord engagement system of claim 9, wherein a portion of coupler is configured to be moved between a plurality of coupler positions within the adjustment slot.

11. The draw cord engagement system of claim 9, comprising an axle supported by the support, wherein:

the first engager defines a first pivot channel;

the second engager defines a second pivot channel;

a pivot axis extends through the first and second pivot channels;

the axle extends along the pivot axis; and the axle extends at least partially into the first and second pivot channels.

12. The draw cord engagement system of claim 11, wherein, during the first repositioning, the second engager is configured to be pivoted relative to the first engager, wherein the pivoting occurs about the pivot axis.

13. A draw cord engagement system comprising:

a support;

a cord holder moveably coupled to the support;

a first engager moveably coupled to the support; and a second engager moveably coupled to the support, wherein the second engager is configured to be coupled to the first engager, wherein the cord holder, the first engager and the second engager are configured to cooperate with each other to enable:

a first repositioning of the first engager relative to the second engager resulting in a first setting; and a second repositioning of at least the second engager relative to the support while the first setting remains unchanged, wherein during the second repositioning, the first and second engagers are configured to unitarily move relative to the cord holder, wherein, as a result of one of the first and second repositionings, at least one of the first and second engagers is positioned so as to interfere with a movement of the cord holder, and wherein the first engager and the second engagers remain coupled to the support during the first and second repositionings.

14. The draw cord engagement system of claim 13, comprising a coupler configured to couple the first engager to the second engager.

15. The draw cord engagement system of claim 14, wherein the coupler is configured to be transitioned between: (a) a decoupling position in which the first and second engagers are moveable independently of each other; and (b) a coupling position in which the coupler causes the first and second engagers to be statically positioned relative to each other, resulting in a positional relationship.

16. The draw cord engagement system of claim 15, wherein the decoupling position enables the first repositioning.

17. The draw cord engagement system of claim 16, comprising a securement member configured to be transitioned between: (a) an unlock position in which the first and second engagers are moveable relative to the support while the first and second engagers comprise the positional relationship; and (b) a lock position in which the securement member positionally fixes the first and second engagers relative to the support while the first and second engagers comprise the positional relationship.

18. A method for manufacturing a draw cord engagement system, the method comprising:

providing a support;

moveably coupling a cord holder to the support;

moveably coupling a first engager to the support; and moveably coupling a second engager to the support so that the second engager is repositionable relative to the first engager; and providing a coupler configured to couple the first engager to the second engager, wherein the cord holder, the first engager and the second engager are operable, while coupled to the support, to cooperate with each other to enable:

a first repositioning of the first engager relative to the second engager resulting in a first setting; and a second repositioning of at least the second engager relative to the support while the first setting remains unchanged, wherein, as a result of at least one of the first and second repositionings, at least one of the first and second engagers is positioned so as to interfere with a movement of the cord holder, and wherein during the second repositioning, the first and second engagers are configured to unitarily move relative to the cord holder.

19. The method of claim 18, comprising providing a coupler configured to couple the first engager to the second engager, wherein the coupler is configured to be transitioned between: (a) a decoupling position in which the first and second engagers are moveable independently of each other; and (b) a coupling position in which the coupler causes the first and second engagers to be statically positioned relative to each other, resulting in a positional relationship.

20. The method of claim 19, comprising providing a securement member configured to be transitioned between: (a) an unlock position in which the first and second engagers are moveable relative to the support while the first and second engagers comprise the positional relationship; and (b) a lock position in which the securement member positionally fixes the first and second engagers relative to the support while the first and second engagers comprise the positional relationship.

21. The draw cord engagement system of claim 1, comprising an axle coupled to the support, wherein the axle couples the first engager and the second engager to the support during the first and second repositionings, wherein the coupler is configured to bind the first engager and the second engager together during the second repositioning.

22. The draw cord engagement system of claim 13, comprising:

an axle coupled to the support, wherein the axle couples the first engager and the second engager to the support during the first and second repositionings; and a coupler configured to fixedly secure the first engager to the second engager together during the second repositioning.

23. The method of claim 18, comprising:

coupling an axle to the support, the first engager and the second engager so that the axle couples the first engager and the second engager to the support during the first and second repositionings, wherein the coupler is configured to bind the first engager and the second engager together during the second repositioning.

* * * * *